US007062927B2

(12) United States Patent
Kwon et al.

(10) Patent No.: US 7,062,927 B2
(45) Date of Patent: Jun. 20, 2006

(54) CENTRAL CONTROL SYSTEM OF AIR CONDITIONERS AND METHOD FOR OPERATING THE SAME

(75) Inventors: Jae Hwan Kwon, Seoul (KR); Sang Chul Youn, Kyungki-do (KR); Duck Gu Jeon, Seoul (KR); Jae Sik Jung, Seoul (KR); Young Soo Yoon, Seoul (KR); Jun Tae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 89 days.

(21) Appl. No.: 10/849,051

(22) Filed: May 20, 2004

(65) Prior Publication Data

US 2005/0097902 A1 May 12, 2005

(30) Foreign Application Priority Data

Nov. 11, 2003 (KR) ..... 10-2003-0079561

(51) Int. Cl.
*F25B 49/00* (2006.01)
*F25B 5/00* (2006.01)
*G05D 23/00* (2006.01)

(52) U.S. Cl. ..... 62/126; 62/199; 236/1 B; 236/51; 236/94

(58) Field of Classification Search ..... 62/126, 62/129, 199; 236/51, 94, 1 B
See application file for complete search history.

(56) References Cited

U.S. PATENT DOCUMENTS 4,174,064 A * 11/1979 Pratt, Jr. ..... 236/1 B
4,509,679 A * 4/1985 Longini ..... 236/94
5,005,365 A * 4/1991 Lynch ..... 62/126
6,279,332 B1 * 8/2001 Yeo et al. ..... 62/125
6,453,687 B1 * 9/2002 Sharood et al. ..... 62/127
2004/0107717 A1 6/2004 Yoon et al.

FOREIGN PATENT DOCUMENTS

JP 62288443 A * 12/1987
JP 01127842 A * 5/1989
KR 2001-0077589 8/2001
KR 2002-0048333 6/2002

OTHER PUBLICATIONS

English Language Abstract of KR 2001-0077589.
English Language Abstract of KR 2002-0048333.

* cited by examiner

*Primary Examiner*—Marc Norman
(74) *Attorney, Agent, or Firm*—Greenblum & Bernstein, P.L.C.

(57) ABSTRACT

A central control system of air conditioners includes a multi-type air conditioning system, a power meter and a central controller. The air conditioning system includes a plurality of indoor units for air conditioning installed in rooms of a building and an outdoor unit for circulation of refrigerant, where the indoor units share the outdoor unit. The power meter is connected to the outdoor unit to measure power consumption of the air conditioning system when the system operates. The central control unit calculates respective power consumptions of the indoor units based on both the power consumption measured by the power meter and operation information of the air conditioning system, and displays the calculated power consumptions of the indoor units. It is thus possible to determine respective power consumption patterns and electricity charges of the indoor units more accurately, thereby improving management efficiency of the entire air conditioning system.

14 Claims, 6 Drawing Sheets

CENTRAL CONTROL SYSTEM OF AIR CONDITIONERS AND METHOD FOR OPERATING THE SAME

BACKGROUND OF THE INVENTION

1. Field of the Invention

The present invention relates to a central control system of air conditioners including a central control unit that transmits and receives data to and from a plurality of air conditioners over a network and can perform central control of operations of the air conditioners, and more particularly to a central control system of air conditioners and a method for operating the same, wherein the central control unit is connected with a power meter for measuring power consumption of the plurality of air conditioners in operation, thereby achieving efficient management and calculation of electricity charges.

2. Description of the Related Art

Demand for air conditioning systems for providing air conditioning in a building is on the rise. Such air conditioning systems are mainly divided into two types. One type is a single-type air conditioning system suitable for providing air conditioning in a small room, and the other is a multi-type air conditioning system that is installed in a large building and allows cooperative management.

As shown in FIG. 1, the single-type air conditioning system includes indoor units 10 installed respectively in rooms and outdoor units 20 that are installed outdoors and connected respectively to the indoor units 10 for circulation of refrigerant. Users separately install and operate air conditioners (each including an indoor unit and an outdoor unit) of the single-type air conditioning system respectively in their rooms of a small building or the like where cooperative management is unnecessary.

On the other hand, the multi-type air conditioning system includes a large number of indoor units installed respectively in rooms and a small number of outdoor units, connected to the indoor units, for distributing refrigerant to the indoor units and controlling circulation of the distributed refrigerant according to input control commands. To accomplish this, the outdoor units monitor in real time operating states of the large number of indoor units.

The multi-type air conditioning system has an advantage over the single-type air conditioning system in that it saves installation space of the outdoor units. The multi-type air conditioning system also has an advantage in that i-t can decrease total power consumption for air conditioning since the large number of indoor units are managed and controlled by the smaller number of the outdoor units, thereby increasing management efficiency.

However, such air conditioners, which circulate refrigerant for providing air conditioning, increase the burden of paying electricity bills since power consumption for starting the air conditioners and power consumption for maintaining operations thereof are very high due to their basic characteristics, compared to other home electric appliances. In addition, in the case where the plurality of indoor and outdoor units of the single-type air conditioning system or the multi-type air conditioning system are installed over the entirety of a building, it is more difficult to perform power management.

An electricity utility company assigns upper power limits (i.e., maximum allowable power consumption levels) to buildings, where the upper power limits vary depending on seasons/time zones/regions. If power consumption exceeds the upper power limits, the electricity utility company charges progressive electricity rates, which increases management costs.

If a fuse of the air conditioning system blows due to an abrupt increase in the peak power consumption, the entire power of the building is cut off, which may cause a physical impact on home electric appliances in use, lowering endurance of the appliances.

Accordingly, the manager of a building, where the plurality of indoor and outdoor units of the single-type air conditioning system or the multi-type air conditioning system are installed, uses a power meter (for example, a watt-hour meter) 30 as shown in FIG. 1 to check power consumption during a predetermined period of time and thus to perform power management for allowing the power consumption to be limited below the upper power limit. Such a check of power consumption also makes it possible to anticipate management costs.

However, the power meter 30 in the conventional air conditioning system can only measure power consumption of all of the electric appliances, including the air conditioners, in the building or can only measure power consumption of the entire air conditioning system. That is, the power meter 30 cannot measure accurate power consumption of each of the indoor units 10 installed respectively in the rooms of the building, making it impossible to perform accurate calculation of electricity charges and accurate division of total electricity charges into respective electricity charges of the rooms.

SUMMARY OF THE INVENTION

Therefore, the present invention has been made in view of the above problems, and it is an object of the present invention to provide a central control system of air conditioners and a method for operating the same, wherein a power meter is connected to an air conditioning system installed in a building, and a central control unit provided in the central control system receives the information of power consumption measured by the power meter to calculate and display respective power consumptions of indoor units and also to calculate respective electricity charges of the indoor units according to the respective power consumptions, thereby achieving effective power management.

In accordance with one aspect of the present invention, the above and other objects can be accomplished by the provision of a central control system of air conditioners, comprising a multi-type air conditioning system including a plurality of indoor units for air conditioning installed in rooms of a building and an outdoor unit for circulation of refrigerant, said outdoor unit being shared by the plurality of indoor units a power meter, connected to the outdoor unit, for measuring power consumption of the multi-type air conditioning system when the multi-type air conditioning system operates; and a central control unit for calculating respective power consumptions of the indoor units based on both the power consumption measured by the power meter and operation information of the multi-type air conditioning system, and for displaying the calculated respective power consumptions of the indoor units.

In accordance with another aspect of the present invention, there is provided a method for operating a central control system of air conditioners, said central control system including a central control unit capable of performing central control of a multi-type air conditioning system including a plurality of indoor units and an outdoor unit connected thereto via a network, said method comprising the steps of a), by the central control unit, receiving information of power consumption of the multi-type air conditioning system from a power meter, said power consumption being measured by the power meter; b) receiving operation information of the multi-type air conditioning system via the outdoor unit; c) calculating respective power consumptions of the indoor units based on the operation information of the multi-type air conditioning system and equipment information previously stored in a database; and d) displaying the calculated respective power consumptions of the indoor units.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
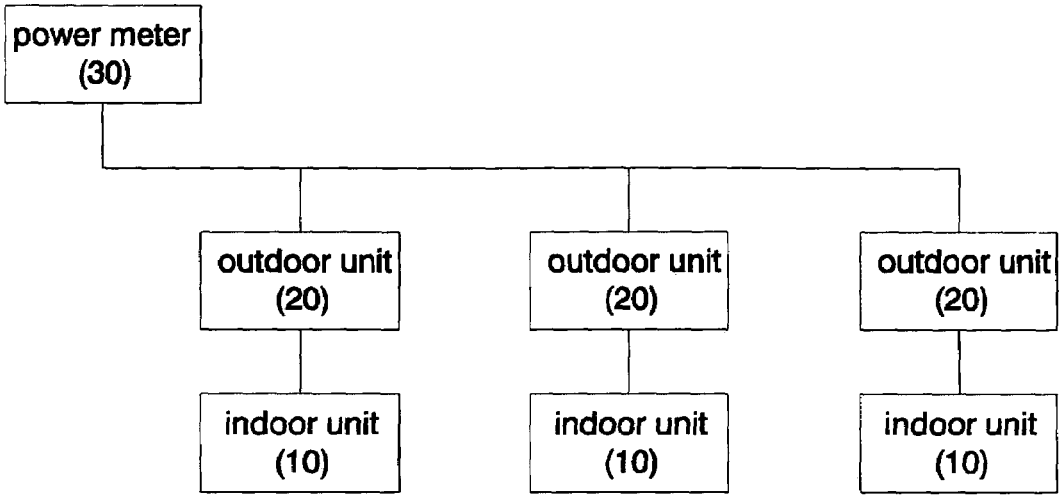
FIG. 1 is a block diagram showing the configuration of a conventional air conditioning system.
Figure 2:
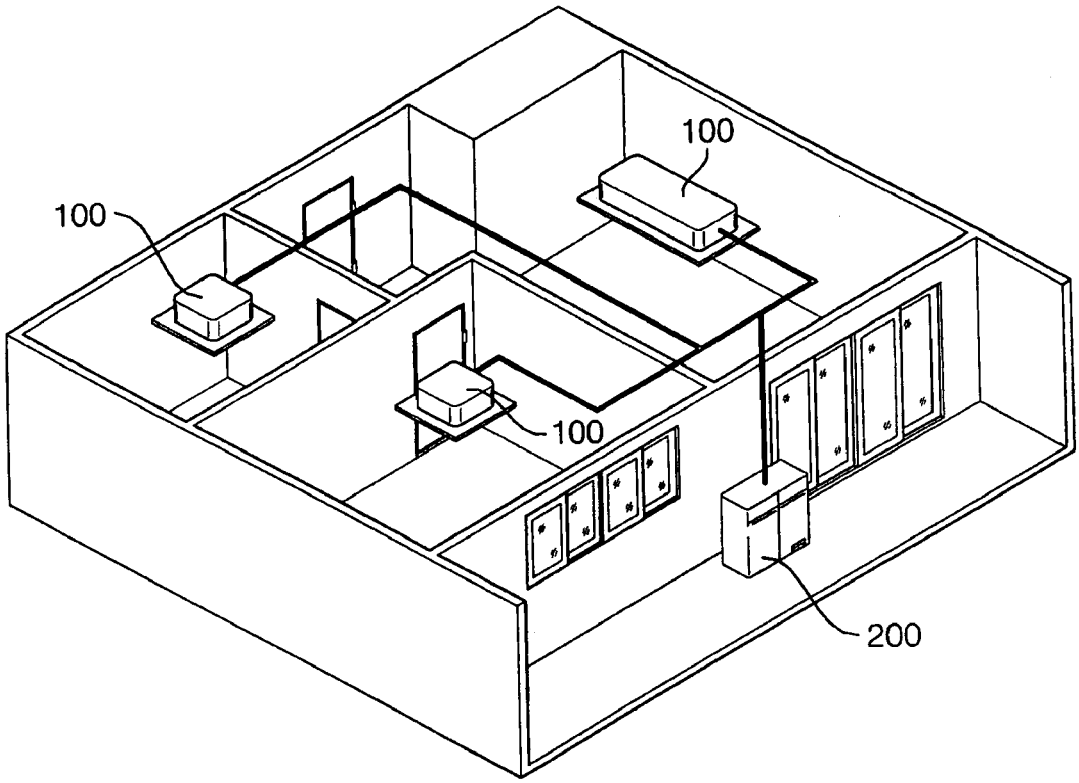
FIG. 2 is a perspective view showing the configuration of a multi-type air conditioning system to which the present invention is applied.
Figure 3:
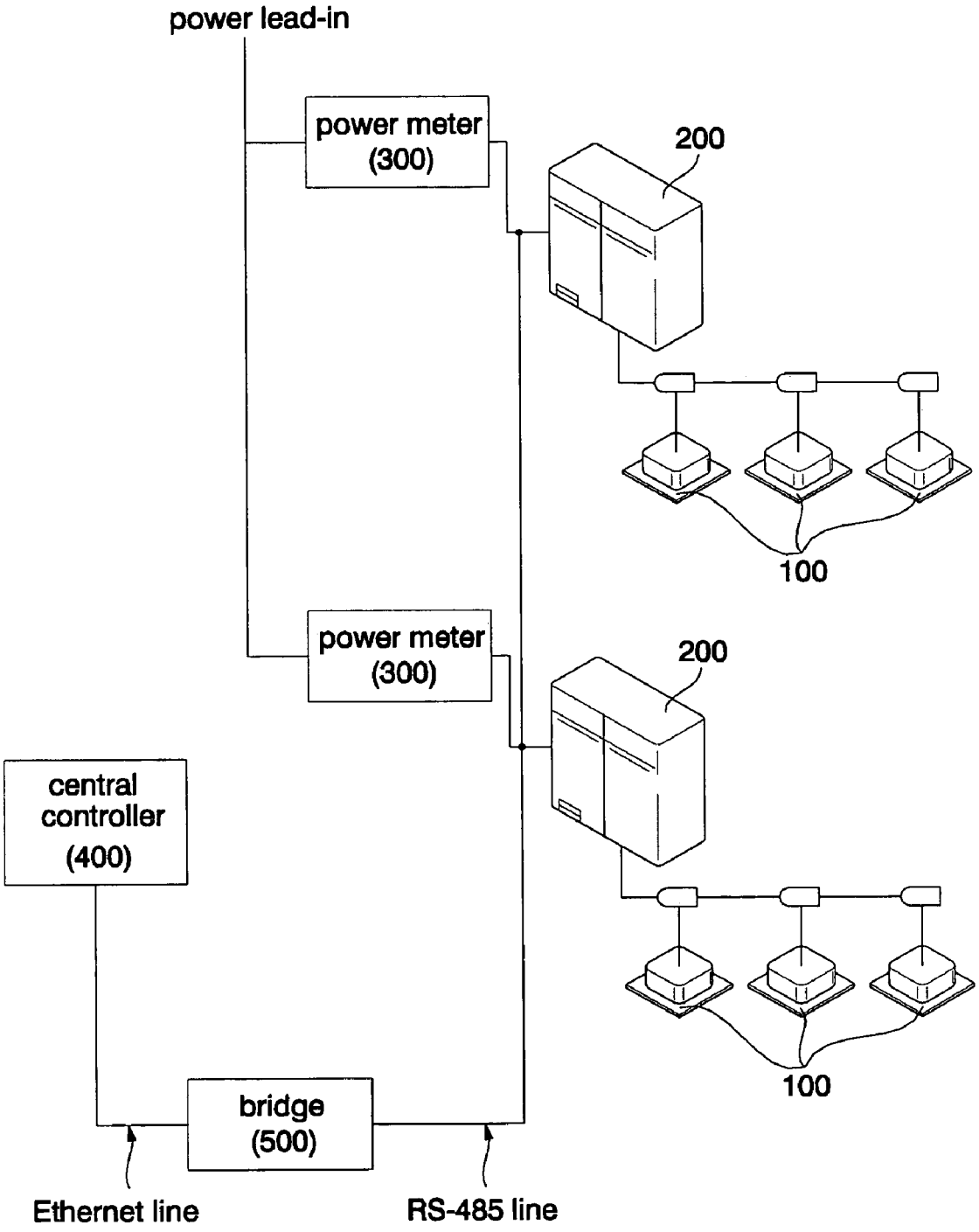
FIG. 3 is a block diagram showing the configuration of a central control system of air conditioners according to the present invention.

The configuration of a central control system of air conditioners according to the present invention will now be described with reference to FIGS. 2 and 3. FIG. 2 shows one multi-type air conditioning system that includes a plurality of indoor units and a single outdoor unit connected thereto and can be installed in a small building. FIG. 3 shows another multi-type air conditioning system which includes a number of indoor units and two or more outdoor units connected thereto and can be installed in a large building. Here, it should be noted that the type and features of an air conditioning system to which the present invention can be applied are not limited to those of the air conditioning system described below and illustrated in the figures.

The multi-type air conditioning system as shown in FIGS. 2 and 3 includes a large number of indoor units 100 and a small number of outdoor units 200 connected thereto and provides sufficient cooling and heating capacities for a building where the air conditioning system is installed. An outdoor unit 200 shared by a plurality of indoor units 100 as shown in FIG. 2 calculates opening ratios of expansion valves in the indoor units 100 according to control commands, and controls the number of revolutions of a compressor to circulate a suitable amount of refrigerant.

In such a multi-type air conditioning system, the outdoor unit 200 can control the speed of a condenser fan according to operating states of the indoor units 100 connected thereto, thereby minimizing energy consumption. To accomplish this, the outdoor unit 200 must detect in real time the operating states of the indoor units 100. For this reason, the outdoor unit 200 is connected with the indoor units 100 via serial communication lines to transmit and receive signals thereto and therefrom.

In the present invention, the indoor units 100 and the outdoor unit 200 communicate signals via RS-485 communication lines. The RS-485 is a serial interface standard, which allows connection of up to 32 drivers and up to 32 receivers per line and can endure high load, thanks to use of low impedance drivers and receivers.

The configuration of such a multi-type air conditioning system will now be described in detail with reference to FIG. 3. As shown in FIG. 3, the multi-type air conditioning system basically includes a small number of outdoor units 200 and a large number of indoor units 100 which are shared by the outdoor units 200 and disposed respectively in rooms of a building.

Any type of indoor unit such as a ceiling-mounted indoor unit, a wall-mounted indoor unit and a standing indoor unit can be used as each of the indoor units 100 disposed in the rooms. Each of the outdoor units 200 is connected to a plurality of indoor units 100 to control circulation of refrigerant according to control commands. The outdoor units 200 are also connected to a power meter (for example, a watt-hour meter) 300 via a serial communication line. The power meter 300 measures power consumed when an air conditioner (including an outdoor unit and indoor units connected thereto) operates during a predetermined period of time. As shown in FIG. 3, an RS-485 communication line is used as the serial communication line in this embodiment.

The small number of outdoor units 200 are connected to a central control unit 400 via an Ethernet communication line over a network. The central control unit 400 can perform central control of the entire air conditioning system of the building. A manager thus can input control commands to the air conditioners or can monitor states of the air conditioners via the central control unit 400. Individual control of the air conditioners is also possible via the indoor units 100.

In addition, the central control unit 400 can be connected to the external Internet. In this case, a user at a remote site can remotely control operations of the air conditioning system in the building by gaining access to the central control unit 400 over the Internet.

The central control system of air conditioners using the central control unit 400 does not require a machine room and thus can reduce initial installation costs of the air conditioners by 30 to 40% and can also greatly reduce operating and management costs thereof. In addition, if heat-pump outdoor units are used, the central control system of air conditioners can also provide heating, enabling various air conditioning functions.

The central control unit 400 is connected to the multi-type air conditioning system via an Ethernet communication line, whereas the multi-type air conditioning system and the power meter 300 are all connected via RS-485 communication lines. For this reason, a bridge 500 for mutual protocol conversion (between the Ethernet and the RS-485) is provided between the central control unit 400 and the multi-type air conditioning system.

Next, the configuration of the central control unit 400 is described with reference to FIG. 4.

Figure 4:
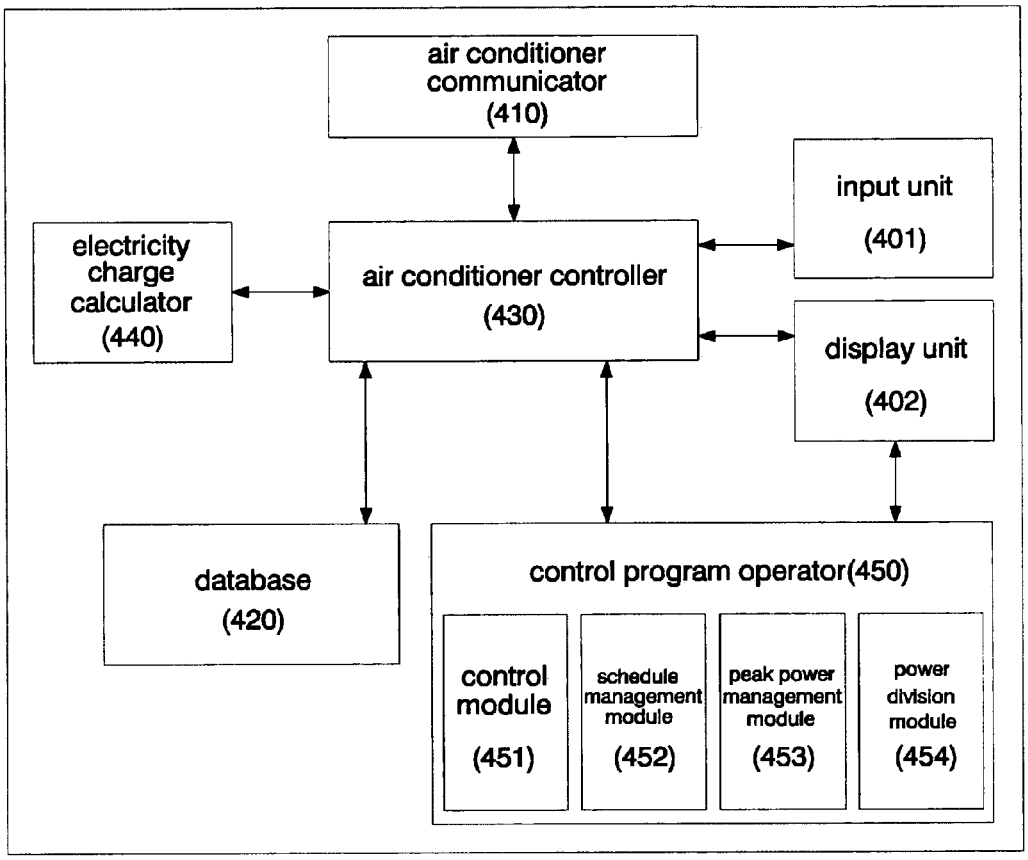
FIG. 4 is a block diagram showing the configuration of a central control unit according to the present invention.

As shown in FIG. 4, the central control unit 400 includes an input unit 401, a display unit 402, an air conditioner communication module 410, a database 420, an air conditioner controller 430, an electricity charge calculator 440, and a control program operator 450.

The air conditioner communication module 410 interfaces with the outdoor units 200, the indoor units 100 and the power meter 300 by transmitting and receiving data thereto and therefrom via RS-485 communication lines.

The central control unit 400 receives information of power consumption from the power meter 300 electrically connected to the outdoor units 200, and calculates respective power consumptions of the indoor units 100 based on the received power consumption information and according to information of operating states of the indoor units 100, received from the outdoor units 200.

The indoor units 100 have different power consumptions when they operate, depending on the types, features, years of installation, models, frequencies of use or the like of the indoor units 100. For this reason, the central control unit 400 includes the database 420 where equipment information of each of the indoor and outdoor units 100 and 200 is previously stored, and the air conditioner controller 430 calculates power consumption of each of the indoor units 100 by assigning different operating weights to the indoor units 100 based on the equipment information stored in the database 420.

The electricity charge calculator 440 can calculate electricity charges of each of the indoor units based on the power consumptions calculated by the air conditioner controller 430. The electricity charges are calculated in different methods depending on regions, seasons and types of buildings. The manager of the building inputs an electricity charge calculation method, presented by the electricity utility company, to the central control unit 400 to previously calculate electricity charges that will be levied on each of the indoor units 100.

It is thus possible to perform total power management of the air conditioning system of the building for preventing the total power consumption from exceeding an upper power limit (i.e., a maximum allowable power consumption level) or a reference management power value of the building. It is also possible to calculate power consumption of each of the indoor units 100 and corresponding electricity charges of each of the indoor units 100. Accordingly, in the case where there are a plurality of independent offices in the building, it is possible to more accurately divide total electricity charges of the building into respective electricity charges of the independent offices.

The central control unit 400 includes the input unit 401 and the display unit 402. The input unit 401 is used to input commands relating to control of the air conditioning system. The display unit 402 displays information of a monitored state, a control result, power consumption, and electricity charges calculated based on the power consumption of each of the indoor units 100. The input unit 401 and the display unit 402 may be integrated into a touch screen to allow easy input manipulation by touching the screen.

A control program for interfering with a user through the input unit 401 and the display unit 402 is executed in the control program operator 450 in the central control unit 400. The control program operator 450 includes a control module 451, a schedule management module 452, and a peak power management module 453. The control module 451 operates to control operations of the multi-type air conditioning system or to monitor states thereof. The schedule management module 452 operates to manage operating schedules of the multi-type air conditioning system. The peak power management module 453 operates to manage peak power consumption of the multi-type air conditioning system in operation for allowing the peak power to be limited below a predetermined level.

The control program operator 450 further includes a power division module 454 through which current power consumption, monthly power consumption, accumulated power consumption, and electricity charges calculated respectively for the indoor units 100 are displayed on the display unit 402.

Figure 5:
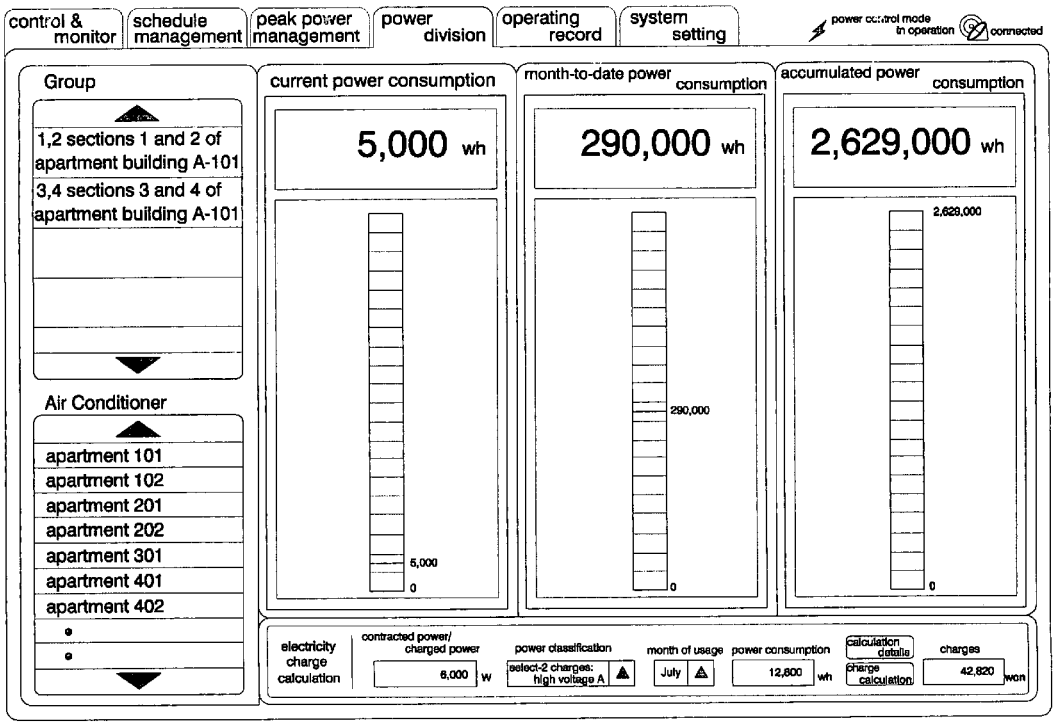
FIG. 5 is a GUI screen of a control program that is executed in the central control unit according to the present invention.

FIG. 5 shows a GUI screen of the control program configured as described above, which allows the manager of the air conditioning system to conveniently perform collective checking of operating states, power consumptions and expected electricity charges of a plurality of air conditioners.

The power division module 454 allows the control program to display air conditioner groups or individual air conditioners as targets of the power management. If an air conditioner is specified among the displayed air conditioners, the power division module 454 allows the control program to display current power consumption, month-to-date power consumption and accumulated power consumption of the specified air conditioner.

If a group of sections 1 and 2 of building A-101 is specified in FIG. 5, air conditioners of 1st and 2nd residences of each floor of building 101 belonging to the specified group can be individually selected. FIG. 5 is a screenshot of the control program when apartment 101 of building A-101 is selected and current power consumption, month-to-date power consumption, accumulated power consumption and calculated electricity charges of an air conditioner of the selected apartment are displayed.

Since the electricity charges of each of the residences are calculated and displayed based on the power consumption of each of the residences, it is possible to easily know respective power consumption patterns of the air conditioners of the residences or offices.

Figure 6:
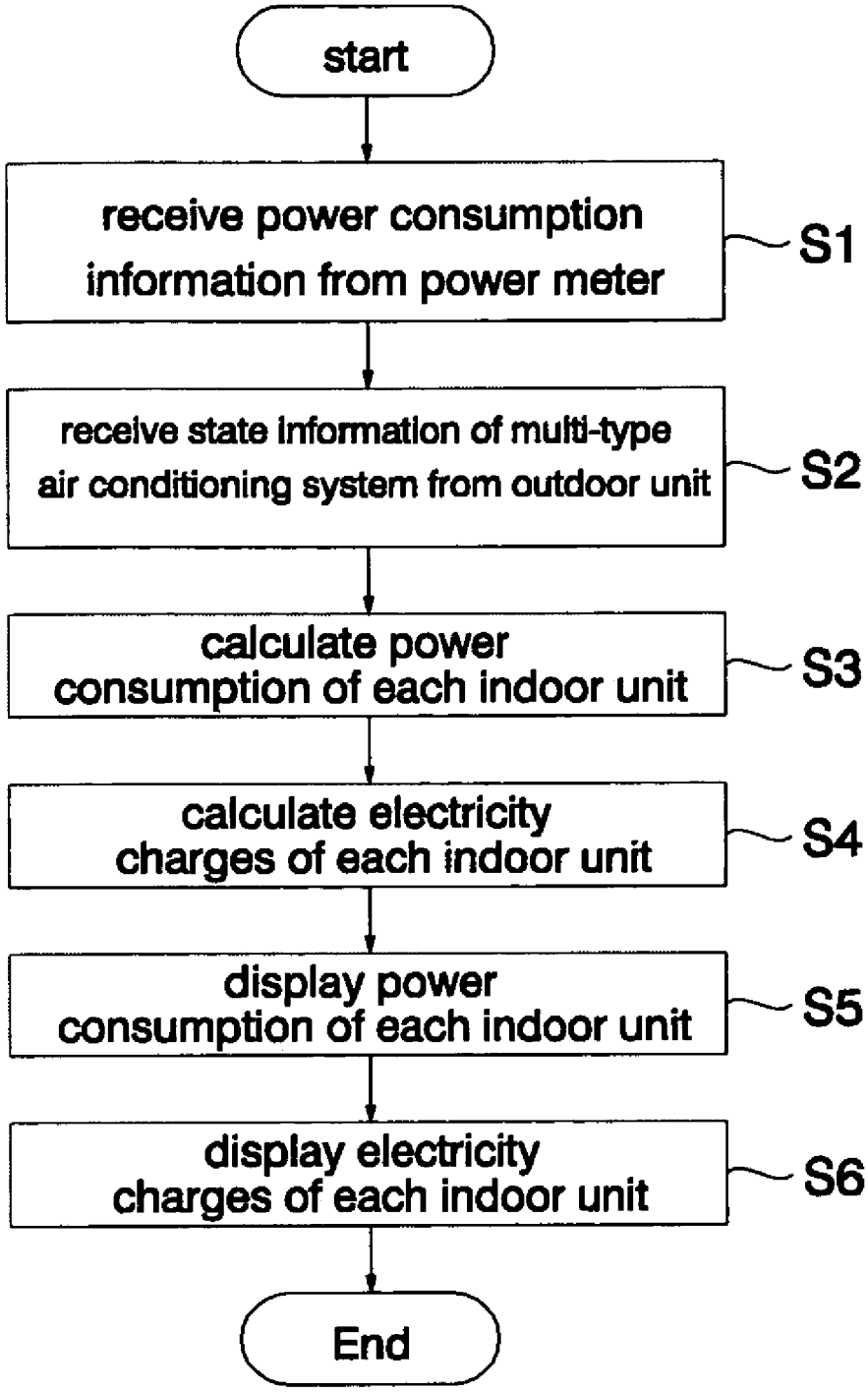
FIG. 6 is a flow chart showing a method for operating the central control system of air conditioners according to the present invention.

A method for operating the central control system of air conditioners according to the present invention will now be described with reference to FIG. 6.

The central control unit receives information of power consumption of the multi-type air conditioning system from the power meter that measures the power consumption (S1).

The central control unit receives state information of the multi-type air conditioning system (i.e., state information for determining operating states of the indoor units) through the outdoor units and receives equipment information previously stored in the database (S2).

The central control unit calculates power consumption of each of the indoor units based on the received power consumption and state information of the multi-type air conditioning system. As described above, the indoor units have different power consumptions when they operate, depending on the types, features, years of installation, models, frequencies of use or the like of the indoor units. For this reason, the central control unit calculates power consumption of each of the indoor units by assigning different weights to the indoor units based on respective product information of the indoor units (S3).

The central control unit calculates respective electricity charges of the indoor units based on the calculated power consumptions of the indoor units (S4).

The calculated power consumption and/or electricity charges of each of the indoor units are displayed (S5 and S6).

As apparent from the above description, a central control system of air conditioners and a method for operating the same according to the present invention have the following features and advantages. The central control system can determine not only the total power consumption of a multi-type air conditioning system but also determine in real time respective power consumptions of indoor units of the air conditioning system and respective electricity charges thereof according to the respective power consumptions. This allows accurate power management and accurate division of total electricity charges into respective electricity charges of the indoor units, thereby improving building management efficiency.

Although the central control system of air conditioners and the method for operating the same according to the present invention have been disclosed for illustrative purposes, those skilled in the art will appreciate that various modifications, additions and substitutions are possible, without departing from the scope and spirit of the invention as disclosed in the accompanying claims.

What is claimed is:

1. A central control system of air conditioners, comprising:

a multi-unit type air conditioning system including a plurality of indoor units for air conditioning installed in rooms of a building and an outdoor unit for circulation of refrigerant, said outdoor unit being shared by the plurality of indoor units;

a power meter, connected to the outdoor unit, for measuring power consumption of the multi-unit type air conditioning system when the multi-unit type air condition system operates; and a central controller for calculating respective power consumption of the indoor units based on both the power consumption measured by the power meter and operation information of the multi-unit type air condition system, and for displaying the calculated respective power consumptions of the indoor units, wherein said central controller includes:

an air conditioner communicator for transmitting and receiving signals to and from the multi-unit type air conditioning system and the power meter via a communication line;

a database for storing equipment information of the indoor and outdoor units of the multi-unit type air conditioning system;

an air conditioner controller configured to control operations of the multi-unit type air conditioning system and to allow display of respective power consumptions of the indoor units calculated based on the current operation information of the multi-unit type air conditioning system and the equipment information stored in the database;

an electricity charge calculator configured to calculate respective electricity charges of the indoor units based on the respective power consumptions of the indoor unit units calculated by the air conditioner controller; and a display configured to display the respective electricity charges of the indoor units calculated by the electricity charge calculator or displaying the respective electricity charges of the indoor units calculated by the air conditioner controller.

2. The system according to claim 1, wherein the indoor and outdoor units are connected via an RS-485 protocol based communication line.

3. The system according to claim 1, wherein the power meter is connected with the outdoor unit via an RS-485 protocol based communication line.

4. The system according to claim 1, further comprising a bridge for mutual protocol conversion of signals transmitted and received between the central controller based on an Ethernet protocol, and the outdoor unit and the power meter, based on an RS-485 protocol.

5. The system according to claim 1, wherein the central controller further includes a control program operator for executing a control program, said control program interfacing with a user for controlling operations of the multi-unit type air conditioning system and for managing power thereof.

6. The system according to claim 5, wherein the control program operator includes a power division module whereby current power consumption, monthly power consumption and accumulated power consumption of the multi-unit type air conditioning system, and electricity charges calculated respectively for the indoor units thereof are displayed.

7. The system according to claim 6, wherein the control program operator further includes:

a control module for controlling operations and monitoring states of the multi-unit type air condition system;

a schedule management module for managing an operating schedule of the multi-unit type air conditioning system; and a peak power management module for managing peak power consumption of the multi-unit type air condition system for controlling the peak power consumption when the multi-type air conditioning system operates to be below a predetermined level.

8. The system according to claim 1, wherein the central controller further includes an input unit that receives a control command for controlling operations of the multi-unit type air conditioning system and transfer the received control command to the air conditioner controller.

9. The system according to claim 8, wherein the input includes a touch screen configured to accept touch input, said display being integrated into said touch screen.

10. The system according to claim 1, wherein the central controller includes an Internet modem configured for connection with an Internet.

11. A method for operating a central control system of air conditioners, said central control system including a central controller configured for performing central control of a multi-unit type air conditioning system including a plurality of indoor units and an outdoor unit connected thereto via a network, said method comprising:

receiving, by the central controller, information of power consumption of the multi-unit type air conditioning system from a power meter, the power consumption being measured by the power meter;

receiving, via the outdoor unit, operation information of the multi-unit type air conditioning system;

calculating respective power consumption of the indoor units based on the operation information of the multi-unit type air conditioning system and equipment information previously stored in a database; and displaying the calculated respective power consumption of the indoor units, wherein the displaying includes:

calculating respective electricity charges of the indoor units based on the calculated respective power consumptions of the indoor units; and displaying the calculated respective electricity charges of the indoor units.

12. The method according to claim 11, further comprising connecting the indoor units and the outdoor unit via an RS-485 protocol based communication line.

13. The method according to claim 11, further comprising connecting the power meter with the outdoor unit via an RS-485 protocol based communication line.

14. The method according to claim 11, further comprising converting signals transmitted and received between the central controller, based on an Ethernet protocol, and the outdoor unit and the power meter, based on an RS-485 protocol.

* * * * *